United States Patent [19]

Bennison

[11] 4,034,877

[45] July 12, 1977

[54] APPARATUS FOR OPENING CONTAINERS

[75] Inventor: Stewart Bennison, Sunnybank, England

[73] Assignee: Bel-Tyne Company Limited, Stockport, England

[21] Appl. No.: 609,717

[22] Filed: Sept. 2, 1975

[51] Int. Cl.[2] ..... B65B 69/00

[52] U.S. Cl. ..... 214/305

[58] Field of Search ..... 214/304, 305, 152; 221/31; 222/81, 82, 83

[56] References Cited

U.S. PATENT DOCUMENTS

| | | | |
|---|---|---|---|
| 3,224,609 | 12/1965 | Dietert | 214/305 |
| 3,467,267 | 9/1969 | Van Elten | 214/305 |
| 3,482,718 | 12/1969 | Moriarty | 214/305 |
| 3,811,586 | 5/1974 | Lavoie | 214/305 |
| 3,884,375 | 5/1975 | Schott, Jr. et al. | 214/305 |

FOREIGN PATENT DOCUMENTS

| | | | |
|---|---|---|---|
| 1,297,550 | 6/1969 | Germany | 214/305 |

*Primary Examiner*—Lawrence J. Oresky
*Attorney, Agent, or Firm*—Fleit & Jacobson

[57] ABSTRACT

A machine for opening bags comprises a pair of spiked rollers mounted adjacent but spaced from each other for rotation in opposite directions. The axes of rotation are parallel and on the same level and a reciprocating knife is disposed between the two rollers. A conveyor brings bags to be opened to the rollers which then carry it onto the knife so that the bag is cut in half allowing the contents to fall out under gravity. The two bag halves may be detached from the rollers by a comb or by making the spikes cyclicly retractable below the roller surface and the mechanism can be enclosed in a pressurized enclosure to restrict the production of dust.

24 Claims, 20 Drawing Figures

APPARATUS FOR OPENING CONTAINERS

The present invention relates to apparatus for and a method of opening containers, particularly, but not exclusively, bags holding a particulate substance.

It will be appreciated that the opening of bags containing particulate material of small particle size is a dust creating process which may be detrimental to the health of people and also to machinery in the vicinity. In the case of some materials, such as asbestos, the occurrence of a particular disease may be directly attributable to the presence of the material in the atmosphere. For these reasons there are health regulations in force in this country with which the bag opening machine must comply if it is to be used for such materials.

According to one aspect of the present invention, there is provided apparatus for opening containers comprising means for cutting open containers to allow the contents thereof to fall out under gravity and means for conveying the containers to the cutting means to allow the cutting action to be carried out.

According to another aspect of the present invention there is provided a method of opening a container comprising the step of conveying the container to cutting means, cutting the container to allow the contents thereof the fall out under gravity and separating the opened container from the contents.

In a preferred embodiment of the invention, the conveyor means comprises an elongate conveyor and two adjacent rollers disposed at the ends of the conveyor.

Advantageously, the rollers are spiked and are mounted for pivotal movement towards and away from one another.

In an alternative form the rollers very simply comprise perforated cylinders to the surface of which bags may be held by the application of suction, through the perforations.

The cutting means may be a band saw, reciprocating blade, rotating wheel or any other suitable cutter.

The rollers are preferably driven from a continuously driven drive motor. The speed may be variable if desired.

In order that the invention may be more clearly understood, one embodiment of the invention will now be described, by way of example, with reference to the accompanying drawings, in which.

Figure 1:
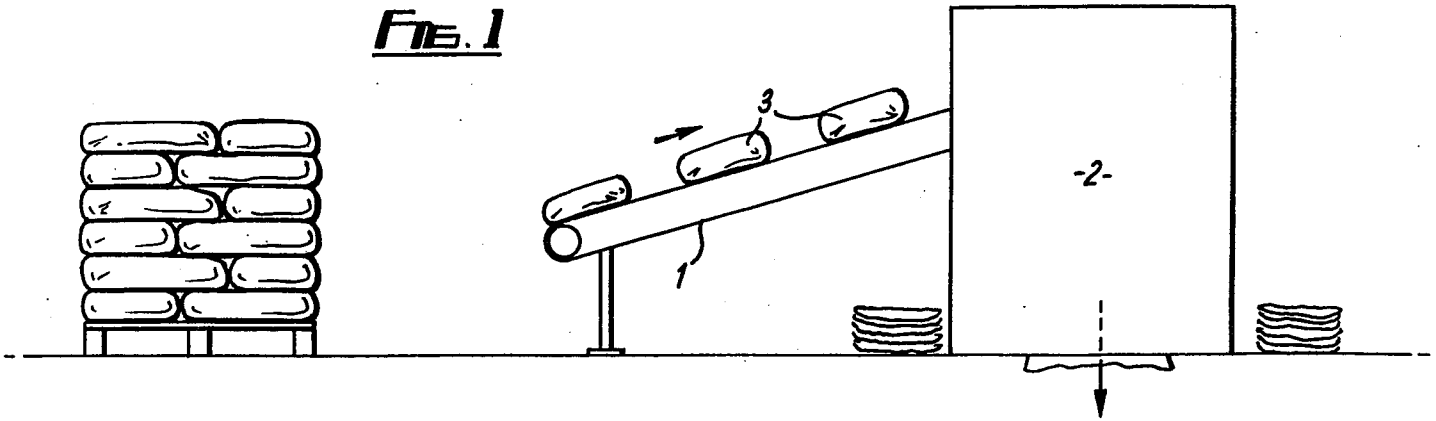
FIG. 1 shows a general arrangement of a bag opening machine in relation to bags to be opened.
Figure 9:
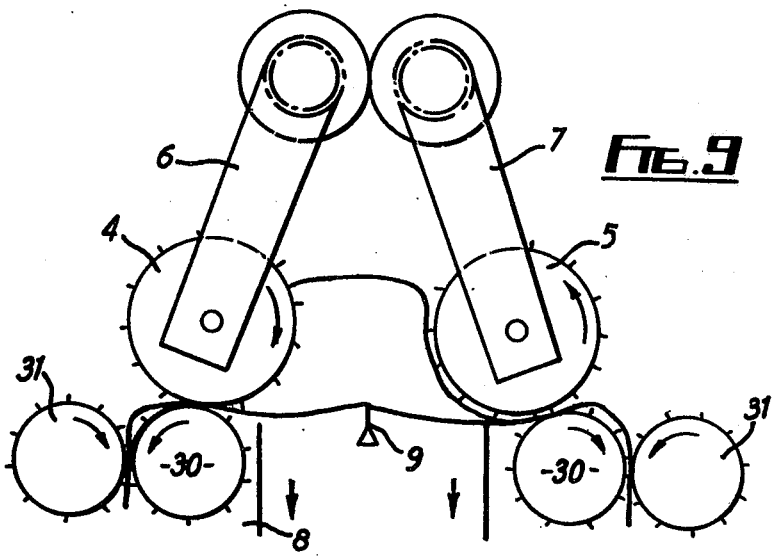
Figure 10:
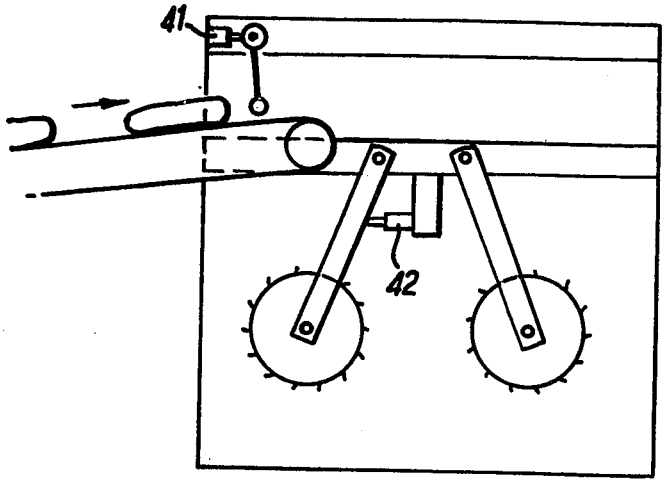
Figure 11:
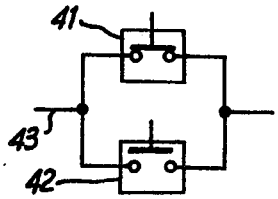
Figure 12:
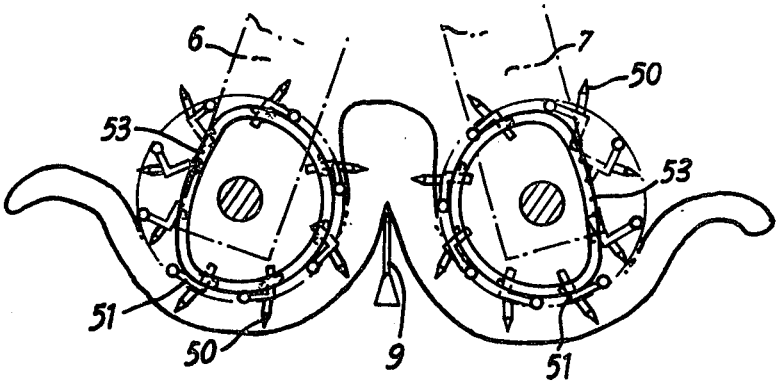
Figure 13:
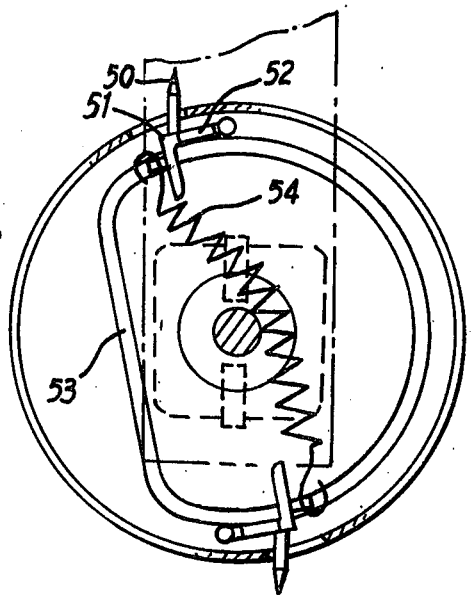
Figure 14:
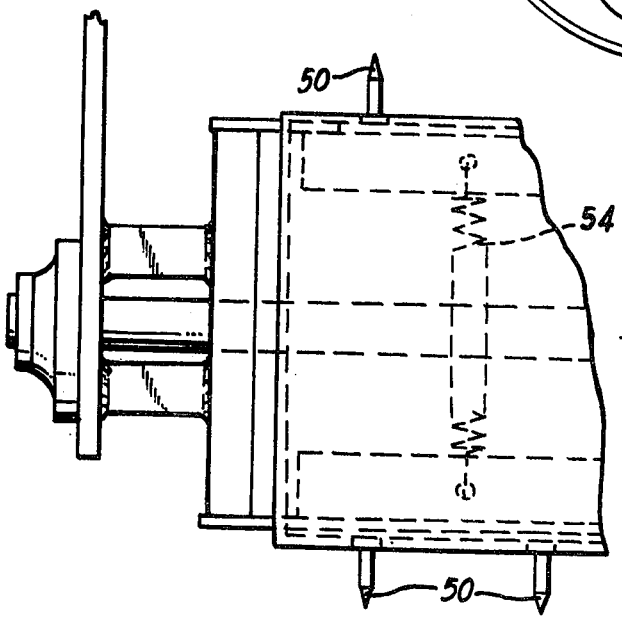
Figure 16:
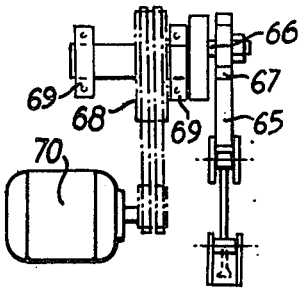
Figure 15:
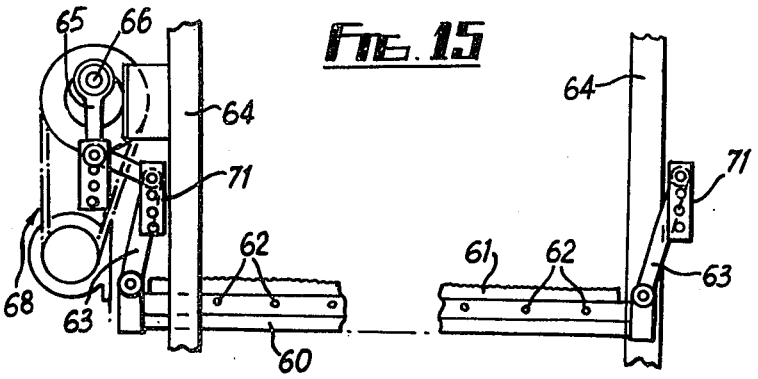
Figure 17:
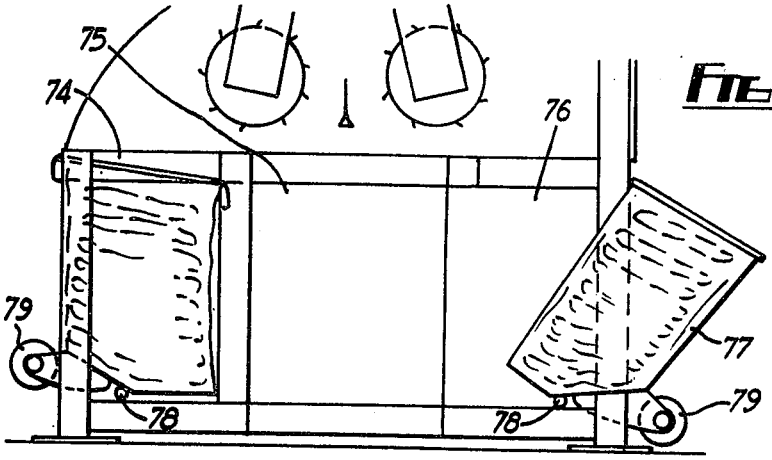
Figure 18:
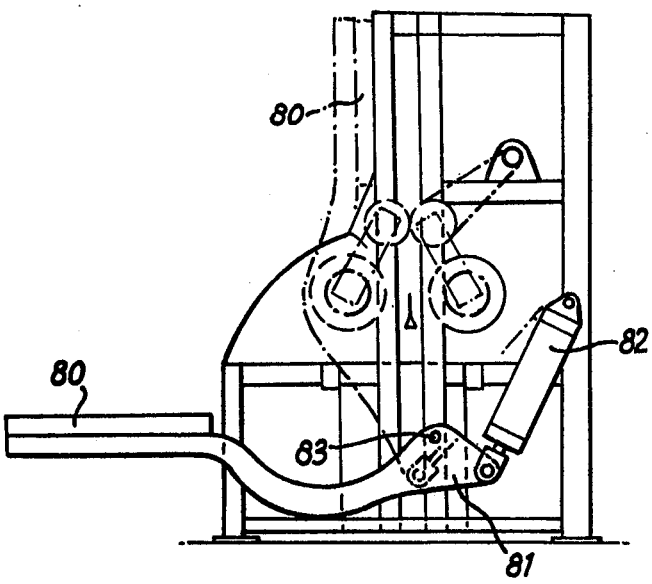
Figure 19:
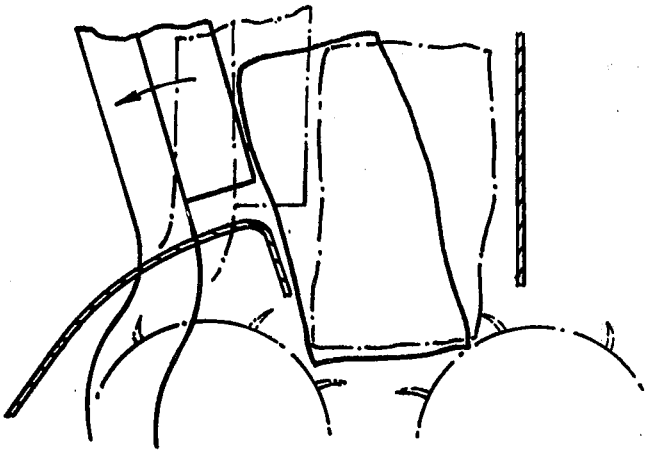
Figure 20:
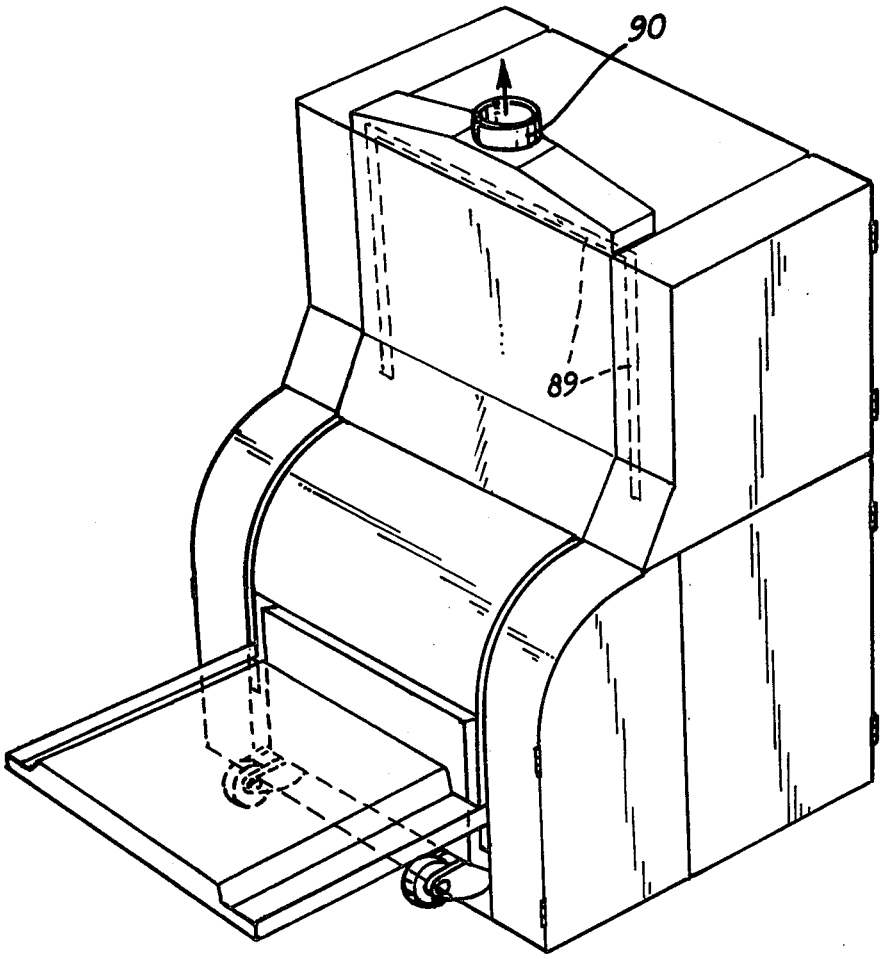

FIG. 9 shows a general arrangement of a shredder fixed to the machine of FIG. 1, FIG. 10 shows the position of limit switches in the machine of FIG. 1, FIG. 11 shows the electrical arrangement of the limit switch of FIG. 10, FIG. 12 shows an alternative form of roller, FIG. 13 shows an end elevational view of one of the rollers of FIG. 12 in more detail, FIG. 14 shows a partial side elevational view of the roller of FIG. 13, FIG. 15 shows a side elevational view of an alternative form of knife arrangement, FIG. 16 shows an end elevational view of the arrangement of FIG. 15, FIG. 17 shows a front elevational view in section of a preferred form of bag collection, FIG. 18 shows a side elevational view in section of a bag-opening machine in FIG. 1, FIG. 19 shows a side sectional view of part of the machine of FIG. 18, and FIG. 20 shows a perspective external view of the machine of FIG. 18 and 19.

Figure 3:
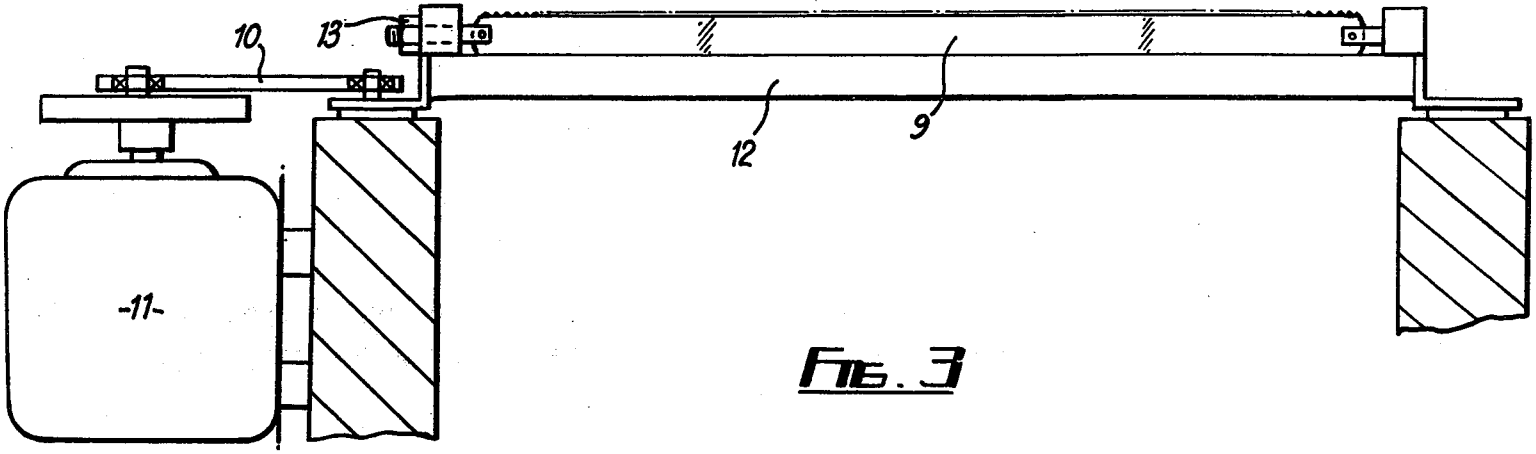
FIG. 3 shows the arrangement of cutting means forming part of the machine of FIG. 1.
Figure 2:
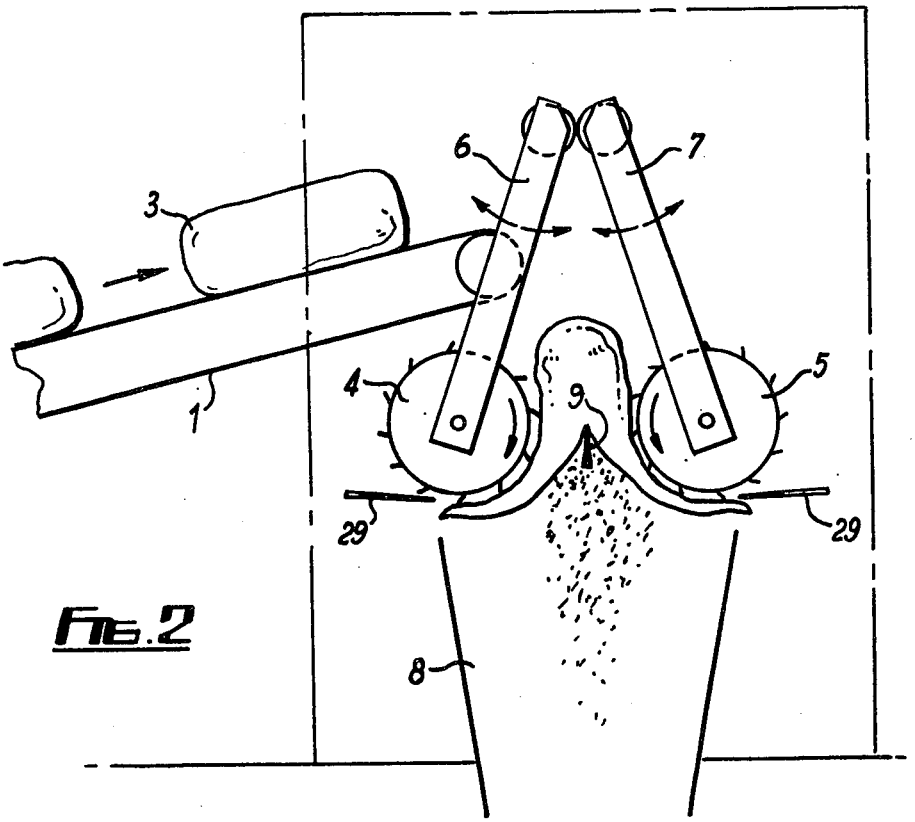
FIG. 2 shows a side elevational view in section of the bag opening machine of FIG. 1.
Figure 4:
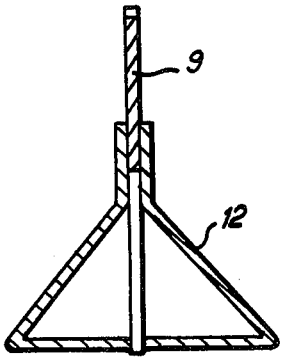
FIG. 4 shows a detail of the cutting means of FIG. 3.
Figure 5:
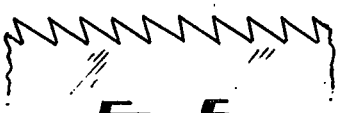
FIG. 5 shows a known form of saw blade.
Figure 6:
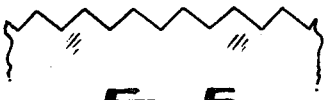
FIG. 6 shows the form of saw blade for the cutting means of FIG. 4.

Referring to FIG. 1, the machine comprises an elongate conveyor 1, leading at an angle to an enclosure 2 and feeding bags 3 to that enclosure. Referring to FIG. 2, in the enclosure 2 there are disposed two spiked rollers 4, 5 disposed at the lower ends of the two pairs of pivotally mounted arms 6, 7 respectively. Directly beneath the rollers 4, 5 is disposed a chute 8 and between the rollers 4, 5 is disposed cutting means in the form of a reciprocating saw blade 9 driven at high speed through a push rod 10 from a drive motor 11, (see FIG. 3). The blade is held by a lightweight fabricated blade holder 12, shown in more detail in section in FIG. 4, and a blade tensioning device 13 is fitted at one end of the blade. The blade, which in this example is approximately 42 inches long, is not formed with normally shaped teeth as shown in FIG. 5, but with teeth of the shape shown in FIG. 5, but with teeth of the shape shown in FIG. 6. This avoids the tendency of normally shaped teeth to lock solid in the bag.

Figure 7:
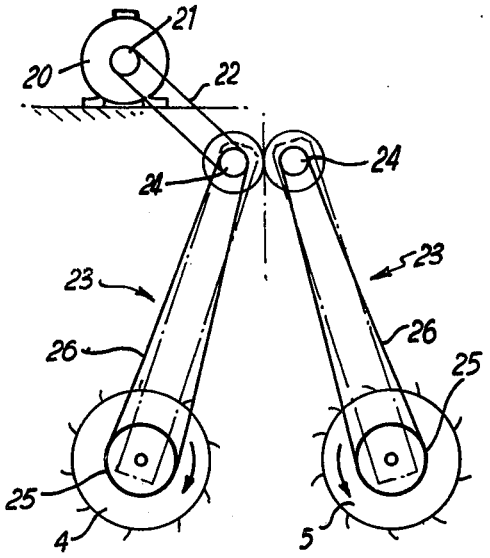
FIG. 7 shows the drive arrangements for rollers of the machine of FIG. 1, in side elevation.
Figure 8:
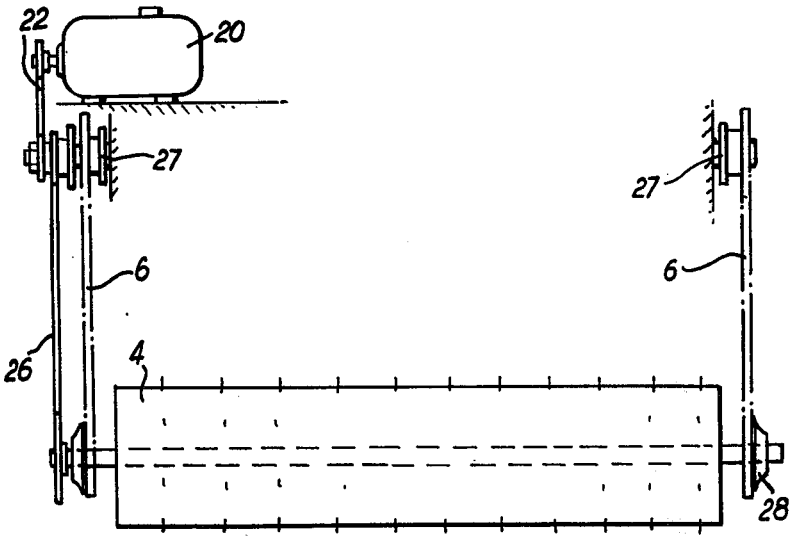
FIG. 8 shows a front elevation of the drive arrangement of FIG. 7.

Referring to FIGS. 7 and 8, a variable speed motor 20 is provided for driving the two rollers 4, 5. The drive from this motor 20 is transmitted from the output shaft of the motor via a sprocket 21 and chain 22 and two further sprocket and chain sets 23 to the rollers 4, 5. The sprocket and chain sets also include two spurs by which the drive to one of the rollers is reversed. Each sprocket and chain set 23 comprise sprockets 24, 25, connected by a chain 26. The sprockets 24 are at the top of respective arms 6, 7, the sprockets 25 are the bottom of respective arms 6, 7 and the chains 26 are aligned with respective arms 6, 7. At the tops of the arms 6, 7 there are also disposed gears 27 to ensure that when the arms 4, 5 are pivoted each arm pivots by the same amount. The rollers 4, 5 are fabricated rollers for easy spike replacement and are supported in the arms through flange type ball bearings 28. It will be appreciated that each pair of arms 6, 7 only has one sprocket and chain set 23.

A comb 29 is disposed adjacent each roller 4, 5 to detach the associated bag half from the roller after the emptying operation.

The operation of the apparatus is as follows: bags are manually transferred from a palette to the conveyor 1 which transports these bags to the rollers 4, 5. These rollers open in dependence upon the size of the bag which is handled. The feeding of the bag is controlled by limit switches so that once a bag has been opened the conveyor is ready to supply another bag.

Referring to FIG. 10 and 11 there are two limit switches 41 and 42 which are wired in parallel and which complete the circuit from the mains 43 to the conveyor motor as shown particularly in FIG. 11.

As the bag comes to the end of the conveyor, the cam operated switch 41 is opened but as the roller arms 6, 7 are in closed position and the switch 42 is closed the conveyor motor continues to feed the bag.

When the bag falls between the rollers the cam switch 41 is again closed while the roller arm switch 42 is now open, the conveyor motor therefore still continues to run.

When the following bag is conveyed to the end of the conveyor, the cam switch 41 is opened and the conveyor motor stops as the switch 42 is also still open. When the roller arms close again, that is, when the bag has been fed through and emptied, the circuit to the conveyor motor is again closed and the conveyor feeds the next bag into the rollers. When the bag falls onto the rollers 4, 5 the spikes penetrate the bag and hold it and rotation of the roller in the direction shown in FIG. 2 carries the bag onto the high speed reciprocation saw blade 9. The preferred maximum saw blade movement is 1 inch. The combined movement of the rollers and the blade progressively slits the bag down the middle while moving the slit halves of the bag away from each other. The contents of the bag then fall into the chute 8 which directs the material in the process as required. The halves of the bag are detached from the rollers 4, 5 by the combs 29 and these halves are piled up on either side of the machine ready for disposal (see FIG. 1) Alternatively the bag halves may be directly fed to a shredder.

Referring to FIG. 9, the shredder comprises two pairs of spiked rollers 30 and 31 with the rollers of each pair rotating in opposite directions to each other and disposed on opposite sides respectively of the central chute 8. In operation, the circumferential speed of the rollers 30 is the same as that of the rollers 4 and 5, but only one third of that of the rollers 31. The two halves of the bag are drawn between the rollers 30 and 31 and the difference in the circumferential speed results in the bag being shredded into strips of paper. The roller 30, 31 can be driven off the same motor as are the main spiked rollers 4 and 5 and the different directions of rotation obtained by appropriate use of gear sprockets and chains.

Referring to FIGS. 12 to 14 an advantageous modified roller arrangement is shown. Instead of having a comb for detaching bag halves from the roller spike the spikes are arranged so that they automatically extend out of and retract into the rollers as the rollers rotate. For this purpose, each row of spikes 50 is mounted on a spike frame 51 which is pivotally connected to the interior of the roller and which extends axially of the roller. A cam follower 52, conneceted to the spike frame 51, extends to the outside of the roller and contacts a substantially D-shaped cam 53 fixed inside the drum. The spike frames are arranged in diametrically opposed pairs, the members of each pair being connected by springs 54 extending between them. These springs constantly urge the cam followers 52 into contact with the cam so that as the roller rotates the cam follower follows the surface of the cam. The effect is seen in FIG. 12 where the spikes are shown fully extended at the top of the rollers where the bag is to be gripped and fully retracted after passing through the lowest point where the bag halves are to be deposited.

Referring to FIGS. 15 and 16, a knife arrangement is shown providing for a much longer stroke (6 inches as opposed to 1 inch) than in the embodiment of FIGS. 1 to 11. To provide for the increased stroke length a knife frame 60, in which the knife 61 is clamped by spaced clamping screws 62, is suspended by two members 63 from the machine frame 64. These members and thus the knife and frame are driven through a push rod 65 which is connected to an eccentric drive. The eccentric drive comprises an eccentrically mounted shaft 66 supported in a ball race 67 driven through a belt and pulley drive 68 (one pulley of which is mounted in pillow bearings 69) from the output shaft of an electric motor 70.

The clamp screws 62 enable the blade to be quickly released. The frame and knife are made as light as possible to enable the loading on the knife driving mechanism to be minimized. A speed from the knife of 250 cycles/min has been found to give an efficient cutting action without creating excessive vibration. Advantageously the cutting edge of the knife lies in a plane passing through the axes of the rollers. The knife position is dependent on the material contained in the bags, however, and where the material is long strand asbestos or is in free flowing powder form, a knife position 1 or 2 inches lower gives a better cutting action. Provision for adjusting the height of the knife is shown in FIG. 15, four pistons being provided for by use of pairs of holes 71.

FIG. 17 shows an alternative bag collection arrangement. The base of the machine is effectively split into three separate sections 74, 76. The outer section 74 and 76 receive the bag halves and the middle section 75 serves as a chute for the material emptied from the bags. Each outer section is shaped to receive a bin 77 having a base shaped to pivot about a pivot bar 78 fixed in the bottom of the section through an angle of 45° from the vertical to facilitate changing of a bin liner when the bin is full. Each bin has a wheel 79 at its base. The bin liner is preferably polythene of 250 gauge and may be clipped over the bin top which is wired for that purpose.

FIG. 18 shows an arrangement of a movable loading platform 80 which enables a bag to be emptied to be lifted from a base position to an upper position in which it can be accepted by the spiked rollers. The platform 80 is mounted on a pair of arms 81 extending on opposite sides respectively of the machine, the base position of the platform being shown in full line and the upper position in dotted line. The platform is moved between the two positions by means of valve controlled pneumatically operable piston and cylinder device 82 which causes the arms 81 to pivot about points 83. The valve, which is hand operated, is biased to the central position thus considerably reducing the possibility of a man being struck by the platform, as the platform will stop when the valve handle is released. Experience has shown that the bag should be vertical when it enters the rollers and the last few inches of movement of the platform are designed to achieve this (see FIG. 19) in this case of a bag which has adopted a non-vertical position after falling off the platform.

Where the machine is employed for opening asbestos bags, it is important that the machine operator avoids contact with asbestos dust. For this purpose the machine incorporates a dust extraction system. To minimize the possibility of dust contamination the machine has been designed with two skins, an inner one to protect the mechanical components and an outer one to protect the operator from the moving parts. The outer panels have been hinged and are fitted with quick release catches to facilitate easy access. The dust extraction system has been calculated to require 1500 c.f.m. of free air to maintain a negative pressure within the machine, even when the loading platform is in the lowered position. FIG. 20 shows the position of the suction slots 89. A negative pressure is maintained across any opening through which dust may escape by drawing air out through an outlet 90. This negative pressure is achieved even when the bins are opened to change the liners.

If desired, rollers comprising perforated cylinders, may be employed instead of the spiked rollers, the bags being held by suction applied through the perforations. Furthermore, other types of cutting means may be employed. For example, the saw blade may be replaced by a band saw, or by a rotating cutting wheel. After leaving the rollers the bags may be fed to a shredder to facilitate disposal of the bags. The arms can be subjected to a shaking movement to ensure that all the contents are dislodged from the bag.

What is claimed is:

1. Apparatus for opening bags comprising conveyor means for conveying bags to a cutting gap, and cutting means disposed in said cutting gap, said conveyor means including means for holding said bags on opposite sides thereof with the broad faces of said bag lying in a vertical plane, and means for gripping the bag on opposite sides of said cutting means whereby opposite vertical faces of the bag are gripped to force the bag past said cutting means, to cut the bag into two halves, each half subsequently being conveyed laterally away from and on opposite sides of said cutting means by said gripping means, said means for gripping also for stripping a bag laterally away from the contents the contents of said bags to fall under the force of gravity from the bag past said cutting means.

2. Apparatus as claimed in claim 1, in which the conveyor means comprises two adjacent rollers.

3. Apparatus as claimed in claim 2, in which the conveyor means comprises an elongate conveyor leading to the two adjacent rollers.

4. Apparatus as claimed in claim 2, in which the conveyor means comprise a pivotable platform which can be pivoted from a first position in which a container may be placed thereon to a second position in which the container may be fed to the two adjacent rollers.

5. Apparatus as claimed in claim 2, in which the rollers are spiked.

6. Apparatus as claimed in claim 5, in which means are provided for extending and retracting the spikes through apertures formed in the surface of each roller.

7. Apparatus as claimed in claim 6, in which the means comprises a cam and one or more associated cam followers to which the spikes are directly or indirectly connected.

8. Apparatus as claimed in claim 6, in which the cam is D-shaped and is fixed outside and relative to the corresponding roller.

9. Apparatus as claimed in claim 6, in which the spikes are disposed in a plurality of axially extending rows and the spikes of each row are mounted on a spike frame which is pivotally connected to the interior wall of the cylinder.

10. Apparatus as claimed in claim 5, in which a comb device is disposed adjacent each spiked roller to detach container halves from the spikes.

11. Apparatus as claimed in claim 1, in which each roller has perforation extending through its curved surface and means are provided for applying suction to the perforation to enable the roller to hold a half of a container.

12. Apparatus as claimed in claim 1, in which the cutting means is a band saw.

13. Apparatus as claimed in claim 1, in which the cutting means is a reciprocating blade.

14. Apparatus as claimed in claim 1, in which the cutting means is a rotating wheel.

15. Apparatus as claimed in claim 13, in which the blade is detachably mounted on a pair of arms whose height may be adjusted to adjust the position of the blade with respect to the rollers.

16. Apparatus as claimed in claim 15, in which the blade is driven through an eccentric drive from an electric motor.

17. Apparatus as claimed in claim 13, in which the cutting edge of the blade lies in a plane extending through the axes of the rollers.

18. Apparatus as claimed in claim 1, in which the rollers are driven from a continuously driven drive motor.

19. Apparatus as claimed in claim 18, in which the drive motor is a variable speed motor.

20. Apparatus as claimed in claim 1, in which the rollers are supported on a pair of pivotally mounted arms.

21. Apparatus as claimed in claim 1, in which a chute is disposed between but below the rollers for guiding away material fall from opened containers.

22. Apparatus as claimed in claim 21, in which two bins are disposed on opposite sides respectively of the chute to receive container halves from opened containers.

23. Apparatus as claimed in claim 22, in which each bin is supported on a bar enabling the bin to be pivoted outwardly to remove the contents.

24. Apparatus as claimed in claim 1, comprising a housing in which the remainder of the apparatus is enclosed and comprising means for producing a pressure differential across opening in the housing to prevent or reduce egress of dust.

* * * * *